US011885184B2

(12) United States Patent
Nguyen et al.

(10) Patent No.: US 11,885,184 B2
(45) Date of Patent: Jan. 30, 2024

(54) PULL-AWAY SHEARING MECHANISM

(71) Applicants: Tuan Nguyen, Pearland, TX (US); Philip M. Gregurek, Katy, TX (US)

(72) Inventors: Tuan Nguyen, Pearland, TX (US); Philip M. Gregurek, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 332 days.

(21) Appl. No.: 17/318,478

(22) Filed: May 12, 2021

(65) Prior Publication Data

US 2022/0364421 A1 Nov. 17, 2022

(51) Int. Cl.
*E21B 17/06* (2006.01)
*E21B 17/046* (2006.01)

(52) U.S. Cl.
CPC ..... *E21B 17/06* (2013.01); *E21B 17/0465* (2020.05)

(58) Field of Classification Search
CPC ..... F16L 25/06; F16L 25/065; F16L 25/08; F16L 37/004; F16L 27/127; E21B 17/06; E21B 17/0465
See application file for complete search history.

(56) References Cited

U.S. PATENT DOCUMENTS 4,094,539 A * 6/1978 Reimert ..... F16L 25/065 285/309
4,260,180 A * 4/1981 Halushka ..... F16L 37/004 285/391
6,328,343 B1 * 12/2001 Hosie ..... E21B 17/046 285/404
6,695,059 B2 * 2/2004 Thomas ..... E21B 33/035 166/368
7,077,212 B2 7/2006 Roesner et al.
7,237,617 B2 * 7/2007 Howlett ..... E21B 17/06 166/381
9,080,395 B2 * 7/2015 Hermes ..... E21B 17/043
10,077,614 B2 * 9/2018 Telfer ..... E21B 17/046
10,781,954 B2 * 9/2020 Remenik ..... F16L 37/004
2004/0258469 A1 * 12/2004 Hofmann ..... E21B 17/04 403/327
2005/0103500 A1 5/2005 Trewhella
2012/0103625 A1 * 5/2012 Yates ..... E21B 33/035 166/368
2014/0048271 A1 2/2014 Coon et al.
2015/0376958 A1 12/2015 Ringgenberg
2022/0196189 A1 * 6/2022 Andersen ..... F16L 15/008

FOREIGN PATENT DOCUMENTS

EP 3133237 A1 2/2017

OTHER PUBLICATIONS

Notification of Transmittal of the International Search Report and the Written Opinion of the International Searching Authority, or the Declaration; PCT/US2022/028505; dated Aug. 29, 2022; 12 pages.

* cited by examiner

*Primary Examiner* — David Bochna
(74) *Attorney, Agent, or Firm* — CANTOR COLBURN LLP

(57) ABSTRACT

A downhole tool including a housing, a movable member movably disposed relative to the housing, a release member extending between the housing and the movable member, a floating nut secured to the shear member and movably received in a recess in the movable member.

15 Claims, 7 Drawing Sheets

PULL-AWAY SHEARING MECHANISM

BACKGROUND

In the resource recovery and fluid sequestration industries, shear release mechanisms are commonplace. They are used to allow for actions to occur only when desired using threshold forces applied mechanically or hydraulically to a tool having a shear release mechanism as a part thereof. Generally, the mechanisms work well but sometimes can cause jamming or scoring of surfaces due to some failure in bending at the shear plane instead of purely shearing failure. Reduction of this issue would be well received by the art.

SUMMARY

An embodiment of a downhole tool including a housing, a movable member movably disposed relative to the housing, a release member extending between the housing and the movable member, a floating nut secured to the shear member and movably received in a recess in the movable member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
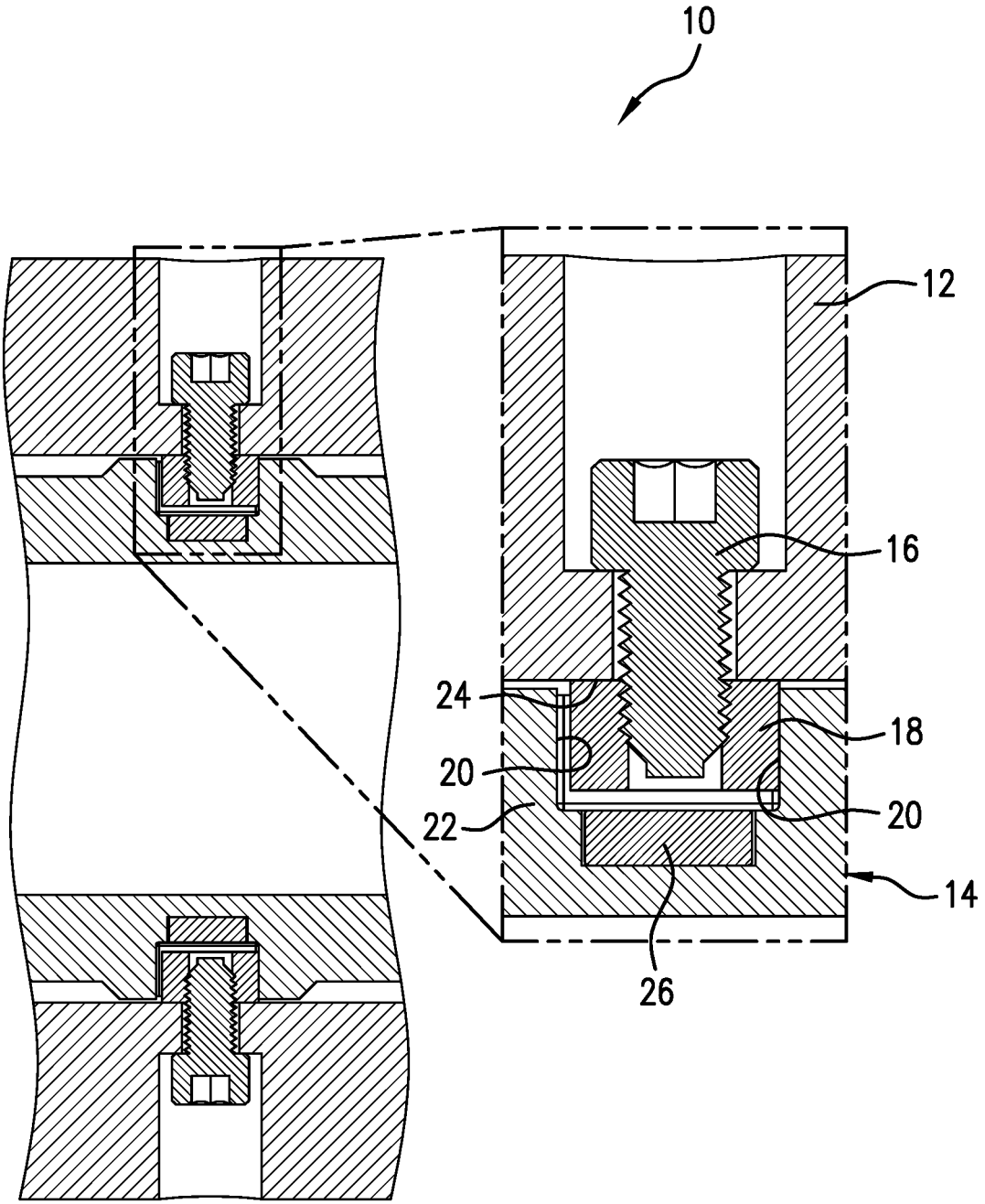
FIG. 1 is an enlarged view of a portion of a downhole tool having a release mechanism displacing arrangement in an unreleased position as disclosed herein.

Referring to FIG. 1, a portion of a downhole tool 10 is illustrated. The portions of the tool 10 that are visible include a housing 12 and a movable member 14 disposed therein. The movable member 14 may be a piston, sliding sleeve, or other structure that moves axially or rotationally or both relative to the housing 14. The housing and member 14 are secured from relative movement in an initial condition by a release member 16. The release member 16 is threadably (or otherwise) securable to a floating nut 18. The floating nut is movably receivable in recess 20 within a wall 22 of member 14. In an embodiment, the nut 18 is movable along an axis of the recess 20 (radial movement relative to the tool 10). The nut 18 may also be rotationally fixed in the recess 20 by geometry. For example, the nut 18 may be square, triangular, or other geometric shape not rotatable in a similar or complementarily shaped recess 20. The nut 18 may also have a dimension radial to the tool 10 that is less than a radial depth of the recess 20 such that if the nut is moved radially inwardly as far as possible, the nut 18 will be radially below a surface of the wall 22.

With the nut 18 as described, it should be appreciated that by threading the member 16 through the housing 12 and into the nut 18, the nut 18 will be drawn against an inside surface 24 of the housing 12. In this position, the nut is also still engaged with the recess 20. This position of the tool 10 is illustrated in FIG. 1. The movable member 14 cannot move relative to the housing 12 in this position. Upon loading however, mechanically, hydraulically, rotationally, etc. the member 16 may be released, in the case of the illustration, by being sheared. The movable member 14 would then be free to move relative to housing 12. It is to be appreciated that because the nut 18 is drawn against the housing 12, the shear plane is very well defined and bending moments applied to the member 16 are almost nonexistent. This ensures a clean shear and hence already reduces the potential for portions of the member 16, post shearing, becoming a problem for the inside surface of the housing 12. Since there is a space in the recess 20 for the nut to move radially inwardly, there is nothing keeping any upset portion of the sheared member 16 (16*b*) in contact with the housing 12. Rather, it could merely be bumped radially inwardly upon contact. This is similar to the radially outward portion 16*a* of the member 16 being unsecured and so it can be bumped radially outwardly. The radially outward portion 16*a* of the separated member 16 generally does not present difficulties for the industry due to this tendency to bump radially outwardly rather than to damage the moveable member 14.

An additional optional feature in an embodiment of the tool 10 is a displacement arrangement 26. The displacement arrangement 26 functions to pull the nut 18 and separated piece of member 16 (16*b*) inwardly of the moveable member 14. In an embodiment, this is accomplished by providing the arrangement 26 with a magnetic field such as via permanent magnet. An electromagnet, low pressure chamber, etc. could be substituted. The arrangement may be placed within the recess 20 or maybe placed adjacent the recess 20 in embodiments. Both are illustrated in FIG. 1 by perceiving the arrangement 26 sitting in an extension of the recess 22 or by perceiving the arrangement 26 to be in its own space adjacent the recess 22.

Figure 2:
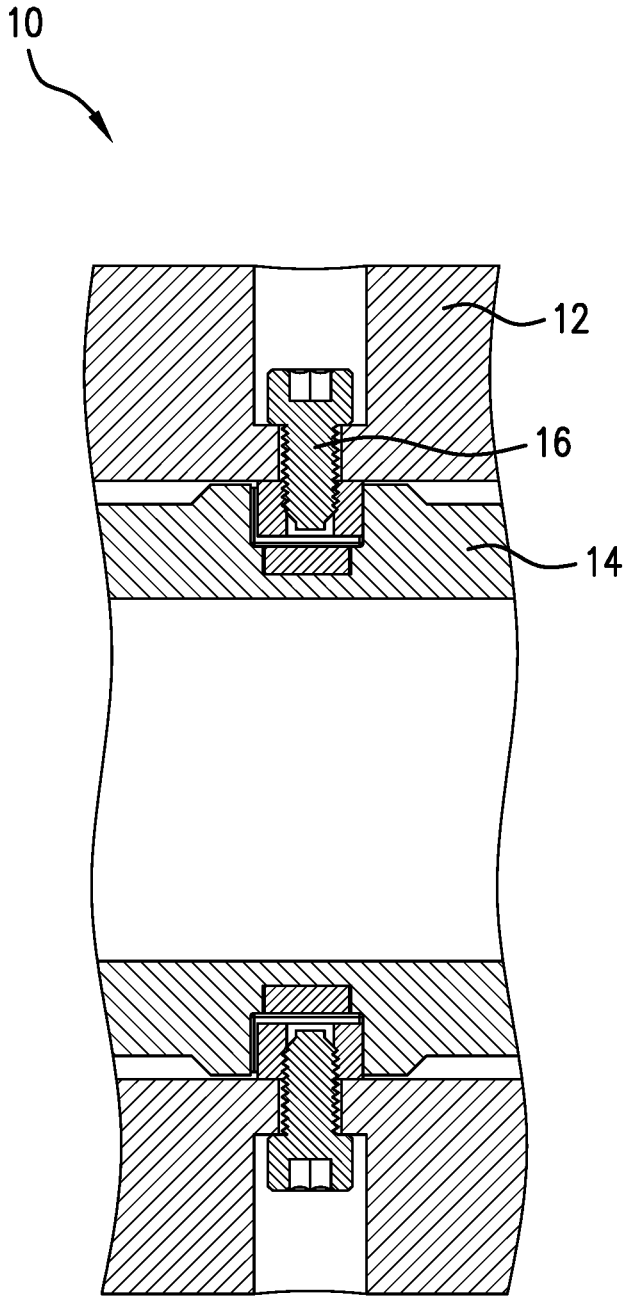
FIGS. 2-4 are a sequence showing a portion of the downhole tool with the release mechanism in an unreleased position, a released pulled back position and a released moved position.
Figure 3:
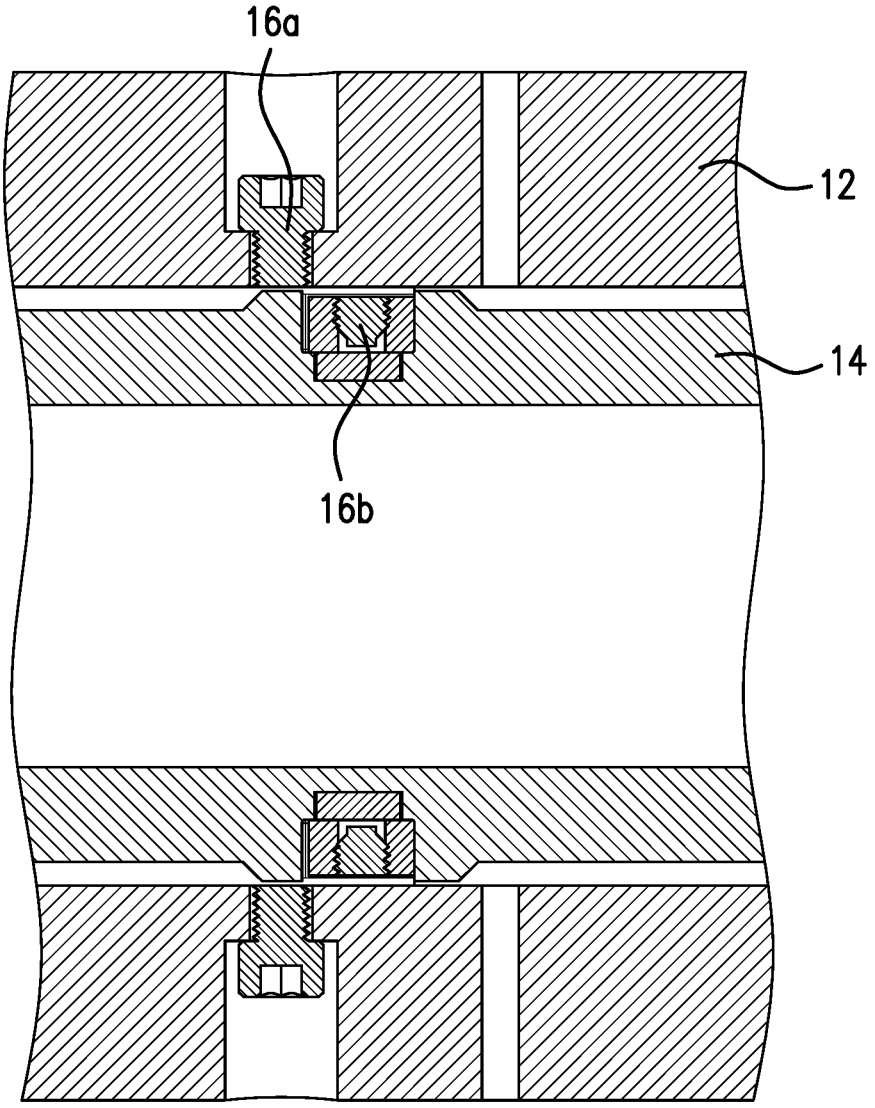
Figure 4:
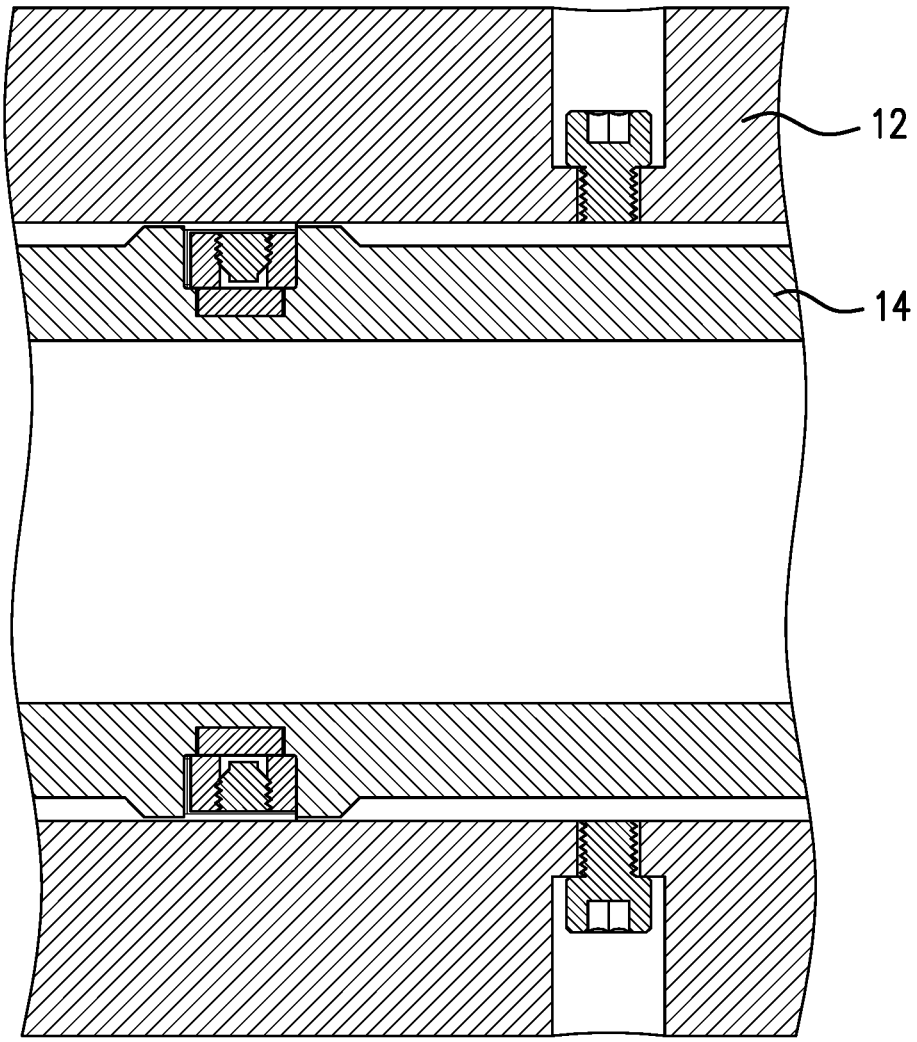

Referring to FIGS. 2-4, a sequence is shown beginning with the unreleased position and showing movement of an embodiment with a load placed upon the tool 10 from the left of the figures. When a load threshold is reached, the member 16 will release (shear as shown). Then the moveable member 14 will move relative to the housing 12. This position is illustrated in FIG. 3. It is also noted that movement in the opposite direction is also supported and this is illustrated in FIG. 4. After reaching the threshold load resulting in release of the member 16, the radially inwardly separated part 16*b* of the member 16 and the nut 18 will be immediately pulled deeper into the recess 20 by the arrangement 26. This ensures that there will be no portion of member 16*b* extending radially outwardly of a surface of wall 22 of movable member 14 allowing for the positions in FIGS. 3 and 4. Avoidance of such condition means that there is no damage to a seal surface of housing 12 or jamming of the member 14 against housing 12.

Figure 5:
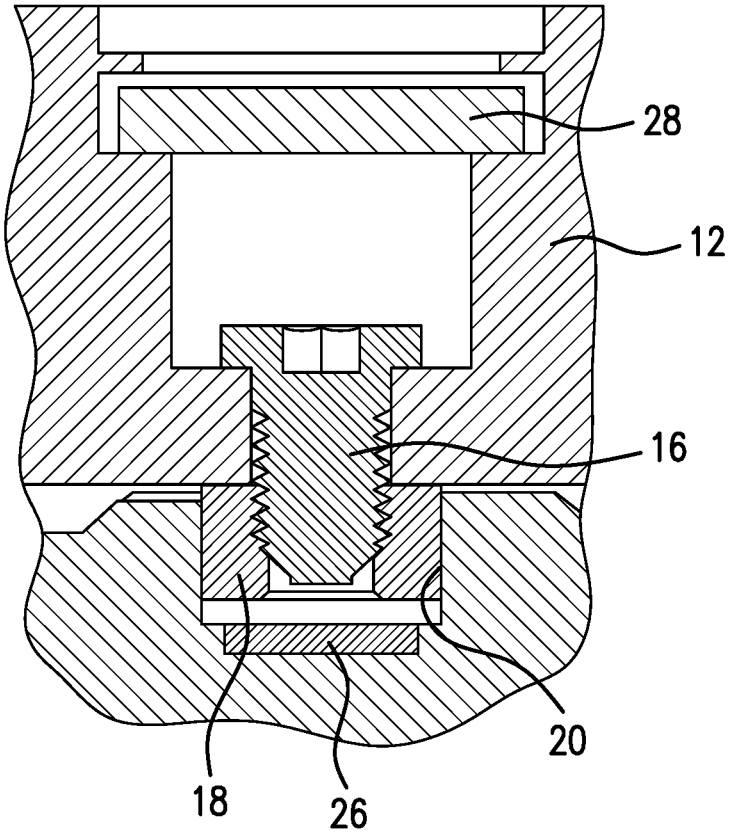
FIG. 5 is a view similar to of FIG. 1 but with an additional optional displacing configuration in the unreleased position.
Figure 6:
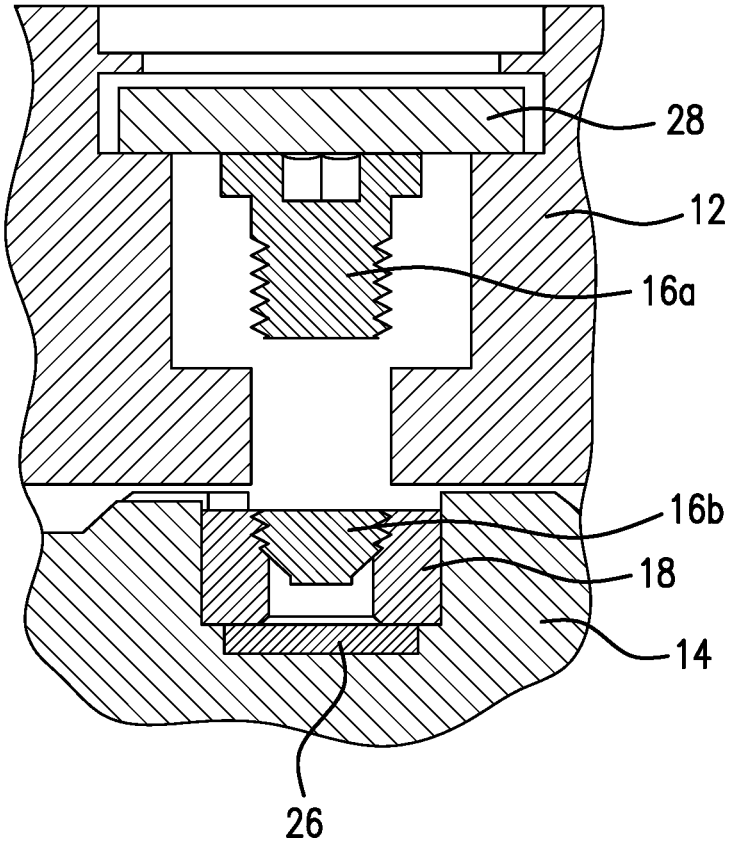
FIG. 6 is the view of FIG. 5 but with the additional optional displacing configuration in the released position.

In another embodiment, referring to FIGS. 5 and 6, an optional additional component may be added. FIGS. 5 and 6 show the option in two positions of the tool 10. In this embodiment, a displacement configuration 28 is added radially outwardly of the member 16 in the housing. This configuration 28 serves one or two functions when employed. First, it prevents the after separation radially outward portion 16*a* of member 16 from dropping into the annulus of the well outside of the tool 10 and becoming untethered debris. Configuration 28 may also, however, be configured with a magnetic field that actively pulls the radially outward portion 16*a* of the member 16 away from the intersection between the housing 12 and the moveable member 14 much like arrangement 26 does as discussed above. Accordingly, in this embodiment, the radially outward portion of member 16 can do no damage to the movable member 14 and also cannot fall out of housing 12 and into the annulus.

Figure 7:
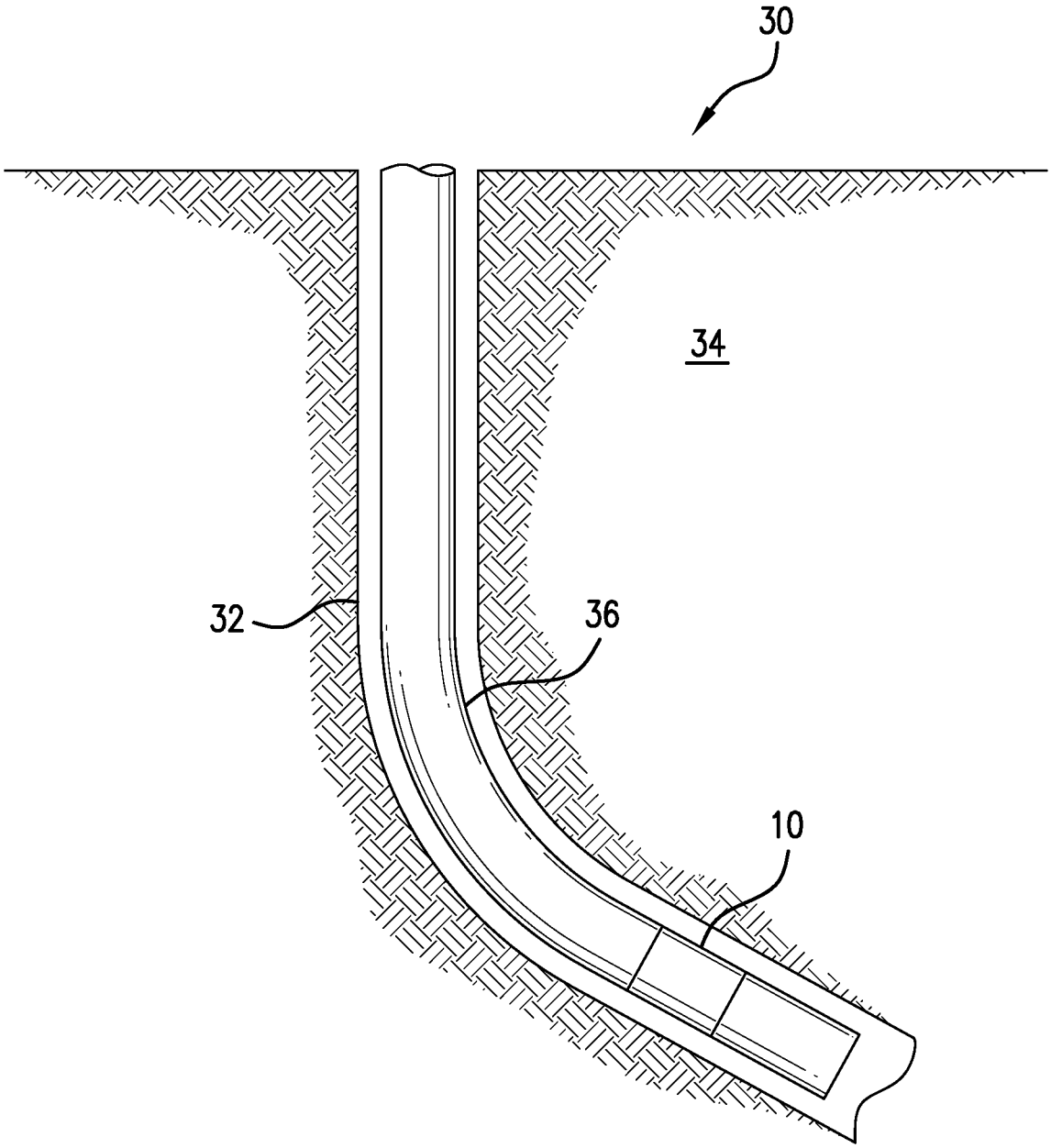
FIG. 7 is a view of a wellbore system including the downhole tool as disclosed herein.

Referring to FIG. 7, a wellbore system 30. The system 30 comprises a borehole 32 in a subsurface formation 34. A string 36 is disposed in the borehole 32. A downhole tool 10 is disposed within or as a part of the string 36.

Set forth below are some embodiments of the foregoing disclosure:

Embodiment 1: A downhole tool including a housing, a movable member movably disposed relative to the housing, a release member extending between the housing and the movable member, a floating nut secured to the shear member and movably received in a recess in the movable member.

Embodiment 2: The downhole tool as in any prior embodiment, wherein the float member is movable radially in the recess relative to the moveable member.

Embodiment 3: The downhole tool as in any prior embodiment, wherein the float member is rotationally fixed relative to the moveable member.

Embodiment 4: The downhole tool as in any prior embodiment, wherein the float member has a radial dimension less than a radial dimension of the recess.

Embodiment 5: The downhole tool as in any prior embodiment, wherein the release member is a shear member.

Embodiment 6: The downhole tool as in any prior embodiment further comprising a nut displacement arrangement.

Embodiment 7: The downhole tool as in any prior embodiment, wherein the arrangement includes a magnetic field.

Embodiment 8: The downhole tool as in any prior embodiment, wherein the arrangement is disposed adjacent the recess.

Embodiment 9: The downhole tool as in any prior embodiment, wherein the arrangement is disposed in the recess.

Embodiment 10: The downhole tool as in any prior embodiment further comprising a release member displacement configuration.

Embodiment 11: The downhole tool as in any prior embodiment, wherein the configuration is a cap disposed in the housing.

Embodiment 12: The downhole tool as in any prior embodiment, wherein the cap includes a magnetic field.

Embodiment 13: A method for operating a downhole tool including loading the release member in the downhole tool as in any prior embodiment, releasing the release member, and displacing the nut.

Embodiment 14: The method as in any prior embodiment, wherein the displacing is deeper into the recess.

Embodiment 15: The method as in any prior embodiment, further including displacing the release member.

Embodiment 16: A method for operating a downhole tool including engaging the release member in the downhole tool as in any prior embodiment with the nut, and drawing the nut partially out of the recess with the release member.

Embodiment 17: The method as in any prior embodiment, wherein the drawing is into contact with the housing.

Embodiment 18: A wellbore system including a borehole in a subsurface formation, a string in the borehole, a downhole tool as in any prior embodiment disposed in or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a housing;

a movable member movably disposed relative to the housing;

a release member extending between the housing and the movable member;

a release member displacement cap disposed in the housing and operably adjacent the release member, the cap including a magnetic field;

a float member secured to the release member and movably received in a recess in the movable member.

2. The downhole tool as claimed in claim 1 wherein the float member is movable radially in the recess relative to the moveable member.

3. The downhole tool as claimed in claim 1 wherein the float member is rotationally fixed relative to the moveable member.

4. The downhole tool as claimed in claim 1 wherein the float member has a radial dimension less than a radial dimension of the recess.

5. The downhole tool as claimed in claim 1 wherein the release member is a shear member.

6. The downhole tool as claimed in claim 1 further comprising a float member displacement arrangement.

7. The downhole tool as claimed in claim 6 wherein the arrangement includes a magnetic field.

8. The downhole tool as claimed in claim 6 wherein the arrangement is disposed adjacent the recess.

9. The downhole tool as claimed in claim 6 wherein the arrangement is disposed in the recess.

10. A method for operating a downhole tool comprising:
loading the release member in the downhole tool as claimed in claim 1;
releasing the release member; and
displacing the float member.

11. The method as claimed in claim 10 wherein the displacing is deeper into the recess.

12. The method as claimed in claim 10 further including displacing the release member.

13. A method for operating a downhole tool comprising:
engaging the release member in the downhole tool as claimed in claim 1 with the float member; and
drawing the float member partially out of the recess with the release member.

14. The method as claimed in claim 13 wherein the drawing is into contact with the housing.

15. A wellbore system comprising:
a borehole in a subsurface formation;
a string in the borehole;
a downhole tool as claimed in claim 1 disposed in or as a part of the string.

* * * * *